United States Patent [19]

McEvily

[11] Patent Number: 4,866,845

[45] Date of Patent: Sep. 19, 1989

[54] KNIFE HOLDING AND SHARPENING BLOCK

[76] Inventor: John B. McEvily, 955 Blvd., Westfield, N.J. 07090

[21] Appl. No.: 171,727

[22] Filed: Mar. 22, 1988

[51] Int. Cl.[4] ..... B24B 3/54; B24D 15/08

[52] U.S. Cl. ..... 30/138; 30/298.4; 51/214

[58] Field of Search ..... 30/296 R, 296 A, 123, 30/138; 51/214, 211 R, 205 WG; 248/37.3; 206/214, 216, 374, 553, 576

[56] References Cited

U.S. PATENT DOCUMENTS

| | | | |
|---|---|---|---|
| D. 225,559 | 12/1972 | Bayly | D44/29 |
| D. 230,122 | 1/1974 | Bayly | D7/74 |
| D. 232,899 | 9/1974 | Bayly | D7/74 |
| D. 249,923 | 10/1978 | Bayly | D7/74 |
| D. 279,951 | 8/1985 | Winyard | D7/74 |
| 1,059,491 | 4/1913 | Schwartz . | |
| 1,131,587 | 4/1915 | Callahan . | |
| 2,413,169 | 12/1946 | Cage | 51/214 |
| 2,441,690 | 5/1948 | Dirksen | 51/156 |
| 2,475,937 | 7/1949 | Alexander | 76/87 |
| 2,744,320 | 5/1956 | Palermo | 30/138 |
| 2,767,530 | 10/1956 | Paldanius | 51/214 |
| 2,826,879 | 3/1958 | Evans | 51/214 |
| 3,676,961 | 7/1972 | Jackson | 51/214 |
| 3,774,350 | 11/1973 | Bayly | 51/204 |
| 3,861,246 | 1/1975 | Waller | 76/86 |
| 3,889,809 | 6/1975 | McNair | 206/372 |
| 4,041,651 | 8/1977 | Bayly | 51/214 |
| 4,091,691 | 5/1978 | Bayly | 76/86 |
| 4,117,748 | 10/1978 | Watts | 76/86 |
| 4,494,339 | 1/1985 | Pittaway | 51/204 |
| 4,604,836 | 8/1986 | Huang | 51/214 |

FOREIGN PATENT DOCUMENTS

| | | |
|---|---|---|
| 51116 | 12/1985 | Australia . |
| 1023945 | 1/1978 | Canada . |

*Primary Examiner*—Douglas D. Watts
*Attorney, Agent, or Firm*—Pennie & Edmonds

[57] ABSTRACT

A block for holding, storing and, if desired, sharpening knives is disclosed. The block includes a body member, at least one and, preferably, a plurality of elongated housing members disposed within the body member. Each housing member includes an open end and defines a cavity within the body member for receiving a knife blade through the open end. Sharpening means are rigidly and angularly disposed within the cavity at a position proximate the open end. The knife blade can be introduced into the elongated housing member in or out of engagement with the sharpening means. When introduced into the elongated housing member in engagement with the sharpening means, it engages the sharpening means at a predetermined angle of orientation, so that the edge of the blade becomes honed while encountering a minimal degree of resistance when being introduced into the elongated housing member.

29 Claims, 1 Drawing Sheet

Fig. 1
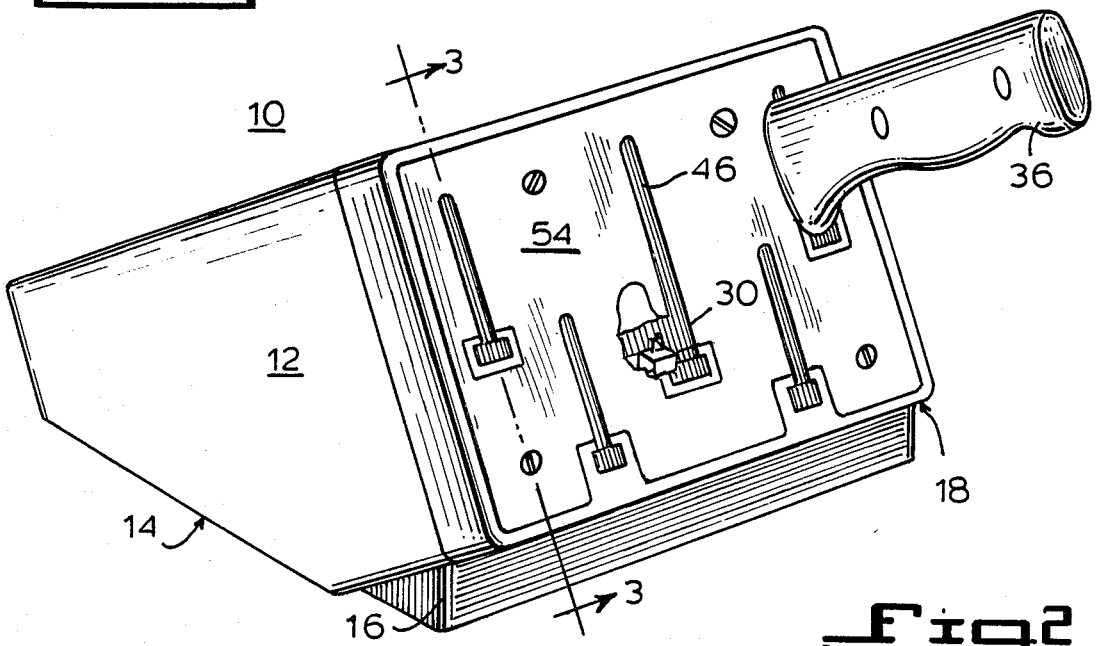
Fig 2
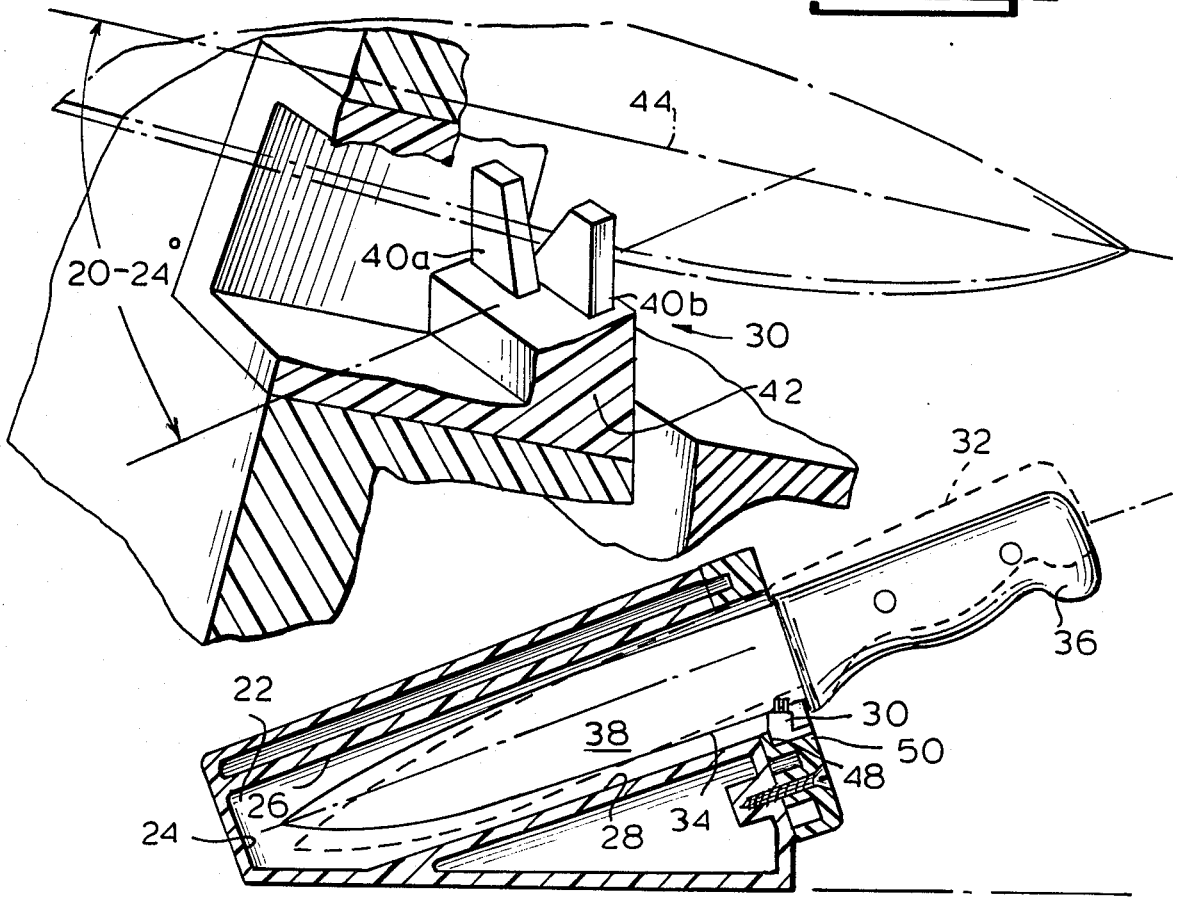
Fig 3

KNIFE HOLDING AND SHARPENING BLOCK

TECHNICAL FIELD

This invention relates to a block for holding, storing and sharpening many ordinary household knives, as well as to certain knives which are particularly designed to be received and held in such blocks and, when necessary, sharpened thereby.

BACKGROUND ART

It is troublesome to constantly maintain ordinary household knives, as well as other knives, in a sharpened condition due to the variations in actual time of usage of the knife. The user does not always remember when the blade should be sharpened until the knife is so dull that it will not cut. Often, it is not convenient to hone or otherwise sharpen the knife blade before each use and, over time, the cutting edge becomes dull, thus rendering the knife difficult to use. Furthermore, the extent to which the knife should be resharpened depends directly upon the dullness of the knife, with duller knives requiring a considerable amount of metal removal to produce a precise, sharp cutting edge.

A number of patent disclosures have recognized this deficiency with such ordinary knives, and provide a housing for receiving, protecting and sharpening or otherwise conditioning the cutting edge of a knife blade as the blade is inserted into or withdrawn from the housing. Typical patents in this area include U.S. Pat. Nos. 2,413,169; 2,475,937; 2,744,320; 2,767,530; 2,826,879; 3,676,961; 3,774,350; 3,861,246; 3,889,809; 4,041,651; 4,091,691 and 4,117,748. Each of these patents describes a device which is designed to sharpen the knife blade upon its insertion into and/or withdrawal from the housing. Each of these patents, with the exception of the '879 patent, include means, such as a spring, a latch member or a resilient member, for biasing the knife blade toward the sharpening elements. The device described in the '879 patent conditions a knife blade by burnishing it with abrasive cushions.

It has now been realized that these devices are deficient because they sharpen the blade upon each insertion and/or removal from the device, whether or not the blade requires sharpening. The sharpening action causes metal to be removed from the blade each time the knife is placed in and out of the scabbard or housing. Most of the time, after a single use of the knife, it is not necessary to sharpen the blade. Hence, these devices provide an unnecessary sharpening which causes the eventual wearing away of the blade.

Another knife sharpener is described in U.S. Pat. No. 4,494,339. This device is similar to those described in the patents mentioned above in that a spring is used to bias the knife blade edge against the sharpener; however, an adjustment knob is provided to vary the spring force and the extent of sharpening of the blade. This spring force may, if desired, be set to zero so as to render the sharpener ineffective.

The device described in the '339 patent is still deficient, however, in that the user of the knife must set the spring force each time the knife is inserted or withdrawn. As a practical matter, most users will set the adjustment at an intermediate position so that, in effect, the device performs the same as those discussed above.

In addition, many of the patents noted above fail to provide a device which can easily be stored on a flat surface, such as a countertop, to provide facilitated access to the user and which can accommodate a plurality of knives varying in size and shape.

U.S. Pat. Nos. 4,117,748 and 4,604,836 each describe a device which functions as a knife holder and sharpener which overcomes some of the deficiencies of the devices described in the aforementioned patents. For instance, U.S. Pat. No. 4,117,748 describes a knife scabbard and sharpening device having a support block and two sharpening plates secured thereto. The two sharpening plates are arranged in opposed and overlapping relationship to define a sharpening recess therebetween. However, in this device, the support block is pivotably mounted on a carrier to provide a rocking movement to the block and sharpening plates to achieve a properly honed knife edge. In addition, the user must vary the approach angle of the blade to distribute the wear over the greater part of each plate to prolong the effective life of the device.

U.S. Pat. No. 4,604,836 describes a safety cutlery case having a sharpening device which sharpens knives when they are driven into or removed from the case. This device also includes a sharpening means which is pivotably mounted within the case. The pivoted movement is necessary to reduce the resistance to the blade and to provide sufficient abrasion against the blade while not damping the movement of the knife. This device also requires a pressing member to retain the knife in engagement with the sharpening means, as is typical of most known devices.

The present invention provides a solution to those problems associated with the known devices in a convenient block having at least one housing member which both holds, protects, and, only when desired, simply and easily sharpens the blade of the knife to the desired extent. Use of the present device avoids the continuous wearing of the blade, yet provides a sharpening device which is readily available for use at the desire of the user, and in which the amount of force used to sharpen the knife blade, if any, is imparted by the user. Furthermore, since the present device does not have to be removed from its usual place of storage to permit a user to gain access to the knife or knives, the convenience of the present device offers an added improvement over the known devices. In addition, the structural arrangement of the sharpening element employed in the device of the present invention enables the user to achieve a perfectly honed blade edge without having to vary the approach angle of the blade, with minimal, if any, resistance to the blade.

SUMMARY OF THE INVENTION

Broadly stated, the present invention relates to a block for holding and sharpening knives which comprises a body member; at least one elongated housing member disposed within the body member having an open end and defining a cavity within the body member for receiving a knife blade through the open end; and means for sharpening an edge of the knife blade, the sharpening means being rigidly and angularly disposed within the cavity at a position proximate the open end, whereby when the knife blade is introduced into the elongated housing member, or removed therefrom, in engagement with the sharpening means, it engages the sharpening means at a predetermined angle of orientation so that the sharpening means sharpens an edge of the knife blade while offering minimal resistance to the force required to urge the knife blade into the elongated housing member.

In a preferred embodiment, the dimensions of the opening, i.e., the ingress to the elongated housing member, and the interior dimensions of the elongated housing member itself are larger than the dimensions of the blade so that the blade may be inserted into and removed from the body member without contacting or engaging the sharpening means. This is done by the user exerting a force on the blade in a direction away from the sharpening means.

Conversely, the blade may be inserted into or removed from the body portion in engagement with the sharpening means, if desired, by the user exerting a force on the blade in a direction towards the sharpening means for sharpening of the edge. The amount of force exerted by the user on the blade when the edge is engaged with the sharpening means can be varied by the user to provide the desired degree of sharpness to the edge. Conveniently, the necessary force may be exerted upon the blade by exerting a force upon the knife handle. This allows left-handed or right-handed users to easily sharpen the blade edge when desired.

BRIEF DESCRIPTION OF THE DRAWINGS

FIG. 1 is a perspective view of a block having a plurality of knife blade receptacles with a portion of the outer surface broken away to illustrate the angular positioning of the sharpening means within the elongated housing member;

FIG. 2 is an enlarged perspective view of the sharpening means with a phantom representation of a knife blade in cooperative engagement therewith and a centerline representation the to illustrate preferred angular relationship; and FIG. 3 is a sectional view taken along lines 3—3 of FIG. 1 illustrating the internal structure of the block and of one elongated housing member with a dotted representation of a knife blade inserted out of engagement with the sharpening means.

DESCRIPTION OF THE PREFERRED EMBODIMENTS

The knife holding and sharpening block of the present invention can provide a storage and conditioning means for a variety of different types of knives. While the present invention is particularly suitable for storing and conditioning culinary knives, the scope of this invention extends to any knife which includes a blade having at least one edge that requires sharpening, and which has a handle attached to or formed integral with the blade.

Referring now to the drawings and, in particular, to FIG. 1, illustrated is a block for holding, storing and sharpening knives generally designated by 10 and which, for purposes of this description, will hereinafter be referred to as sharpening block 10. Sharpening block 10 includes a body member 12 which is generally rectangular and which progressively inclines from the surface on which it rests. The rectangular configuration of sharpening block 10 is abruptly terminated along its lower surface, the proximity of which is designated at 14, permitting it to rest on a flat surface, such as a countertop. Support wedge 16 is disposed within the bight formed between the flat surface and the inclined lower surface 18 of sharpening block 10 to prevent it from tilting forward, especially when being used to store a plurality of knives or when one or more knives are being removed from sharpening block 10.

Sharpening block 10 can be fabricated from wood, plastic, metal, an alloy or any combination thereof or, for that matter, from any material which possesses and is capable of maintaining the integrity necessary to accommodate and support a plurality of knives.

Sharpening block 10 further includes at least one and, preferably, a plurality of elongated housing members 22, as best illustrated in FIG. 3. Regardless of the exact number of elongated housing members employed, they will all be substantially identical differing only in size, which size is dictated by the size of the knife blade to be inserted and stored therein. Thus, for purposes of simplicity, this description will relate to one elongated housing member, it being understood that any others employed would be substantially similar.

As illustrated in FIG. 3, elongated housing member 22 is a cavity adapted to serve as a receptacle, which is angularly disposed within body member 12. The angular or inclined positioning of elongated housing member 22 substantially corresponds to the angle of inclination of body member 12. The angular positioning is, of course, indicative of a preferred arrangement and it is certainly within the scope of this invention to position the body member 12 and elongated housing member 22 in a coplanar relation to the surface on which the sharpening block 10 is rested.

Elongated housing member 22 is defined by inner rear wall 24, inner upper wall 26 and inner lower wall 28. Preferably, elongated housing member 22 is interiorly dimensioned larger than the blade of the knife to be received therein so that when the blade edge 34 of the knife is adequately honed and requires no further sharpening, for instance, when the knife has only been used a minimal number of times subsequent to a previous sharpening by frictional engagement with sharpening means 30, the user can insert the knife blade within elongated housing member 22 out of engagement with sharpening means 30 as illustrated by the dotted representation 32 in FIG. 3. This arrangement advantageously permits the user to exercise discretion to avoid sharpening the edge of the blade 34 unnecessarily which, in turn, prolongs the longevity of the knife. If the user decides that edge 34 requires sharpening, a simple degree of manual pressure exerted on the knife handle 36 to bias edge 34 into frictional engagement with sharpening means 30, as the blade 38 is being inserted within elongated housing member 22, is all that is necessary. The degree of sharpness desired to be imparted to edge 34 is directly proportionate to the amount of manual pressure exerted upon knife handle 36 as knife blade 38 is being inserted into the elongated housing member 22. Of course, a greater degree of pressure will result in a more precisely honed edge.

Conversely, if the user decides that edge 34 is adequately honed and that any further sharpening could only have a deteriorative effect on the blade 38, the knife is inserted into elongated housing member 22 out of engagement with sharpening means 30 by simply exerting an upward pressure on handle 36 with a concomitant forward pressure to insert the blade 38 into elongated housing member 22. After the blade 38 is completely inserted within elongated housing member 22, the rear most portion of blade 38 can be rested upon sharpening means 30.

Edge 34 can also be honed, if desired, as knife blade 38 is being removed from elongated housing member 22. If the user wishes to have edge 34 honed, blade 38 is withdrawn from elongated housing member 22 in frictional engagement with sharpening means 30 and, conversely, if knife blade 38 is withdrawn from elongated housing member 22 out of engagement with sharpening means 30, no further honing of edge 34 will occur.

Referring collectively now to FIGS. 2 and 3, sharpening means 30 includes two sharpening elements 40*a*, 40*b*. Sharpening elements 40*a*, 40*b* are fabricated from any material having a rigidity that is sufficient to effectively hone a knife blade which is made from metals, stainless steel or other alloys typically used in the manufacture of knife blades. Preferably, sharpening elements 40*a*, 40*b* are fabricated from tungsten carbide or a ceramic material and, most preferably, from tungsten carbide.

Sharpening elements 40*a*, 40*b* are carried by support block 42 and are arranged thereon in an adjacent overlapping relationship, which arrangement is best seen in the enlarged perspective view of FIG. 2. Such an arrangement results in a space provided between sharpening element 40*a*, 40*b*, such that when blade 38 is passed through the space, either in a forward or reverse direction, sharpening element 40*a* hones one side of edge 34 while sharpening element 40*b* hones the opposite side thereof.

A significant feature of the present invention resides in the manner of positioning the sharpening means 30 within elongated housing member 22. In sharpening devices described in the prior art, sharpening elements have been pivotally mounted within a housing to reduce any resistance to the blade when being passed over the sharpening elements. In this regard, U.S. Pat. No. 4,604,836 is exemplary. In the present sharpening block, however, sharpening means 30 is rigidly fixed within elongated housing member 22 and is advantageously positioned at a predetermined angle of orientation therein, so that when blade 38 is passed into elongated housing member 22 in frictional engagement with sharpening means 30, specifically with sharpening elements 40*a*, 40*b*, the two communicate at the predetermined angle orientation to substantially alleviate any resistance to blade 38 and, at the same time, provide a sufficient abrasive force against the blade to precisely hone edge 34.

Referring particularly to FIG. 2, illustrated is the preferred angular positioning of sharpening means 30. Specifically, sharpening means 30 is angled between about 20° to about 24° with respect to the longitudinal axis 44 of blade 38 when blade 38 is introduced substantially along the horizontal plane of elongated housing member 22. The lower limit of this angling range can be extended to about 18°; however, an angle ranging between about 20° to about 22° is most preferred.

Referring to FIGS. 1, 2 and 3, sharpening means 30 is conveniently positioned proximate and, even more preferably, adjacent to the opening 46 of elongated housing member 22. The positioning of sharpening means 30 at this locus is preferred since, when blade 38 is inserted into elongated housing member 22 or removed therefrom in frictional engagement with sharpening means 30, substantially the entire edge 34 of blade 38 becomes honed.

Sharpening means 30 can be fixedly mounted on shoulder 48 disposed within body member 12. As illustrated, shoulder 48 can be defined within support member 50 which can be integral with body member 12 or associated therewith in abutting relation. Support member 50 can be attached to body member 12 if not integrally formed therewith, by screw 52 or by any other suitable means, such as by glueing. A combination of glue and screws is particularly preferred.

As illustrated in FIG. 1, a face plate 54 is placed over support member 50 in communication therewith and is attached thereto by screws 46. The screw 46 can, if desired, be of a sufficient length so as to attach face plate 54 to support member 50 and pierce support member 50 so that it becomes attached to body member 12, as is best seen in FIG. 3.

Face plate 54 includes a plurality of oblong apertures which correspondingly align with the open ends 46 of elongated housing member 22. A variety of elongated housing members 22 can be included with sharpening block 10 depending upon the member of knives desired to be stored therein.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A block for holding and sharpening knives which comprises a body member;

at least one elongated housing member disposed within said body member having an open end and defining a cavity within said body member for receiving a knife blade through said open end; and means for sharpening an edge of said knife blade, said sharpening means being rigidly and angularly disposed within said cavity at a position proximate said open end at an angle of about 18° to about 24° with respect to said knife blade when said knife blade is introduced substantially along the horizontal plane of said elongated housing member, whereby when said knife blade is introduced into said elongated housing member, or removed therefrom, in engagement with said sharpening means, it engages said sharpening means at said predetermined angle of orientation so that said sharpening means sharpens an edge of said knife blade while offering minimal resistance to the force required to urge said blade into said elongated housing member.

2. The block of claim 1 wherein said at least one elongated housing member is angularly disposed within said body member.

3. The block of claim 1 wherein said sharpening means includes two sharpening elements arranged in an adjacent overlapping relationship, said sharpening elements being carried on a support block.

4. The block of claim 3 wherein said sharpening elements are fabricated from tungsten carbide or a ceramic material.

5. A block for holding and sharpening knives which comprises:

an elongated housing member having an open end and defining a cavity therein for receiving a knife blade through said open end; and means for sharpening an edge of said knife blade, said sharpening means being rigidly and angularly disposed within said cavity at a position proximate said open end at an angle of about 18° to about 24° with respect to said knife blade when said knife blade is introduced substantially along the horizontal plane of said elongated housing member, whereby when said knife blade is introduced into said elongated housing member, or removed therefrom, it is capable of engagement with said sharpening means, and when so engaged contacts said sharpening means at said predetermined angle of orientation so that said sharpening means sharpens an edge of said knife blade while offering minimal resistance to the force required to urge said knife blade into said elongated housing member.

6. The block of claim 5 wherein said sharpening means is disposed within said cavity at an angle of about 20° to about 22°.

7. The block of claim 1 wherein said sharpening means is positioned adjacent to said open end.

8. The block of claim 1 wherein said sharpening means is mounted on a shoulder disposed within said body member at a position proximate said open end.

9. The block of claim 8 wherein said shoulder is associated with said body portion.

10. The block of claim 8 wherein said shoulder is integrally formed with said body portion.

11. The block of claim 1 which includes a plurality of elongated housing members.

12. A block for holding and sharpening knives which comprises:

an elongated housing member having an open end and defining a cavity therein for receiving a knife blade through said open end; and means for sharpening an edge of said knife blade, said sharpening means being rigidly and angularly disposed within said cavity at a position proximate said open end at an angle of 18°–24° when said knife blade introduced into said elongated housing member, or removed therefrom, it is capable of engagement with said sharpening means, and when so engaged contacts said sharpening means at said predetermined angle of orientation so that sharpening means sharpens an edge of said knife blade while offering minimal resistance to the force required to urge said knife blade into said elongated housing member, wherein said elongated housing member and open end thereof is interiorly dimensioned larger than said knife blade so that said knife blade may be introduced into said elongated housing member out of engagement with said sharpening means to avoid sharpening said edge.

13. A block for holding and, if desired, sharpening knives which comprises;

a body member;

at least one elongated housing member disposed within said body member having an open end and defining a cvity within said body member for receiving a knife blade through said open end;

means for sharpening an edge of said knife blade, said sharpening means being rigidly disposed within said cavity at a position proximate said opene nd and at an angle of about 18° to about 24° with respect to said knife blade when said knife blade is introduced substantially along the horizontal plane of said elongated housing member, said elongated housing member being interiorly dimensioned larger than said knife blade so that said knife blade may be introduced into ro removed from said elongated housing member in or out of engagement with said sharpening means, whereby when said knife blade is introduced into or removed from said elongated housing member out of engagement with said sharpening means any sharpening of said blade is avoided and when said knife is introduced into said elongate housing member, or removed therefrom, in engagement with said sharpening means, it engages said sharpening means at a predetermined angle of orientation so that said sharpening means sharpens an edge of said knife blade while offering minimal resistance to the force required to urge said knife blade into said elongated housing member.

14. The block of claim 13 wherein said at least one elongated housing member is angularly disposed within said body member.

15. The block of claim 13 wherein said sharpening means includes two sharpening elements arranged in an adjacent overlapping relationship, said sharpening elements being carried on a support block.

16. The block of claim 15 wherein said sharpening elements are fabricated from tungsten carbide or a ceramic material.

17. The block of claim 15 wherein said sharpening means is disposed within said cavity at an angle of about 20° to about 22°.

18. The block of claim 13 wherein said sharpening means is positioned adjacent to said open end.

19. The block of claim 13 where said sharpening means is mounted on a shoulder disposed within said body member at a position proximate said open end.

20. The block of claim 19 wherein said shoulder is associated with said body portion.

21. The block of claim 19 wherein said shoulder is integrally formed with said body portion.

22. The block of claim 13 which includes a plurality of elongated housing members.

23. The block of claim 5 further comprising a body member surrounding said elongated housing member.

24. The block of claim 12 further comprising a body member surrounding said elongated housing member.

25. The block of claim 24 wherein said body member surrounds a plurality of elongated housing members.

26. The block of claim 1 wherein each housing member includes a knife associated therewith.

27. The block of claim 5 wherein each housing member includes a knife associated therein.

28. The block of claim 12 wherein each housing member includes a knife associated therewith.

29. The block of claim 13 wherein each housing member includes a knife associated therewith.

* * * * *